US008323004B2

(12) United States Patent
Homma et al.

(10) Patent No.: US 8,323,004 B2
(45) Date of Patent: Dec. 4, 2012

(54) FUEL SUPPLY DEVICE

(75) Inventors: Bunji Homma, Kiryu (JP); Naoyuki Yamate, Wako (JP); Hiroshi Yamada, Wako (JP)

(73) Assignees: Mitsuba Corporation, Gunma (JP); Honda Motor Co., Ltd., Tokyo (JP)

( * ) Notice: Subject to any disclaimer, the term of this patent is extended or adjusted under 35 U.S.C. 154(b) by 258 days.

(21) Appl. No.: 12/654,195

(22) Filed: Dec. 14, 2009

(65) Prior Publication Data

US 2010/0178180 A1 Jul. 15, 2010

(30) Foreign Application Priority Data

Jan. 14, 2009 (JP) ..... 2009-5694

(51) Int. Cl.
*F04B 17/00* (2006.01)

(52) U.S. Cl. ..... 417/410.1; 417/423.1; 310/71; 439/587

(58) Field of Classification Search ..... 417/410.1, 417/423.1, 423.3; 310/71, 87; 439/587
See application file for complete search history.

(56) References Cited

U.S. PATENT DOCUMENTS 5,066,242 A * 11/1991 Martucci ..... 439/281
5,709,450 A * 1/1998 Francis et al. ..... 362/546
6,083,023 A * 7/2000 Kamath ..... 439/263
2004/0253125 A1* 12/2004 Kobayashi et al. ..... 417/410.1
2005/0201877 A1* 9/2005 Mitsudou ..... 417/423.14

FOREIGN PATENT DOCUMENTS

| | | |
|---|---|---|
| EP | 1 467 083 | 10/2004 |
| JP | 2002-54520 | 2/2002 |
| JP | 2002-285931 | 10/2002 |
| JP | 2003-193926 | 7/2003 |
| JP | 2003-201932 | 7/2003 |
| JP | 2006-141113 | 6/2006 |
| JP | 2007-270627 | 10/2007 |
| WO | 03/044357 | 5/2003 |

* cited by examiner

*Primary Examiner* — Devon Kramer
*Assistant Examiner* — Dominick L Plakkoottam
(74) *Attorney, Agent, or Firm* — Wenderoth, Lind & Ponack, L.L.P.

(57) ABSTRACT

A male terminal is provided in a terminal hole formed in a flange unit. A female terminal and a grommet having a sealing portion to be fitted into the terminal hole are provided to a harness. A distance from an end of the sealing portion to a fore-end of the female terminal is set smaller than a distance from a fore-end of the male terminal to an opening of the terminal hole. With such setting, the grommet is retained in the terminal hole even if the female terminal is disconnected from the male terminal, thereby ensuring support of the female terminal. Moreover, a stopper is attached so as to cover the terminal hole to prevent the grommet from slipping out of the terminal hole.

2 Claims, 8 Drawing Sheets

FUEL SUPPLY DEVICE

BACKGROUND OF THE INVENTION

1. Field of the Invention

The present invention relates to a fuel supply device for a vehicle, which uses an electric pump device, in particular, a structure of a terminal connection portion of a wiring for feeding power to a motor, in a fuel supply device for a two-wheel motor vehicle.

2. Description of the Related Art

In recent years, a fuel pump module obtained by integrating a fuel pump, a pressure controller, a strainer, and the like is widely used as a fuel supply device for vehicles such as two-wheel and four-wheel vehicles, in view of the reduction of the number of components, the improvement of efficiency of an assembly operation, and the like. In the fuel pump module, an electric pump device (hereinafter, referred to simply as an "electric pump" as needed) driven by an electric motor is used as the fuel pump. The fuel pump is unitized together with the motor for driving the fuel pump and the like to be provided in a fuel tank or in the vicinity thereof.

In the fuel supply device, the pump module is formed by fixing the electric pump, the strainer, a pressure regulator, and the like onto a disc-like member called a flange. The flange is mounted onto an opening of the fuel tank. As a result, the pump module, i.e., the fuel supply device is placed in the fuel tank. When the electric pump is driven, a fuel in the fuel tank is sucked into the fuel supply device through a filter. After being strained by the strainer and subjected to pressure control by the pressure controller or the like, the sucked fuel is supplied to a fuel supply system of an engine.

On the other hand, in the fuel supply device as described above, a wire harness for connecting power-feeding terminals provided to the flange and the pump module to each other is provided as feeder wirings for feeding electric power to the electric pump. The power-feeding terminals on the flange side are electrically connected to external supply terminals which are connected to a power supply such as an on-vehicle battery. Electric power used for driving is fed from the power-feeding terminals to the electric pump through the wire harness. Male terminals are provided inside the flange as the power-feeding terminals. The wire harness is connected to the male terminals so that female terminals provided to a fore-end of the wire harness are respectively fitted to the male terminals.

FIG. 11 is an explanatory view illustrating a structure of a portion at which the male terminals on the flange side and the female terminals on the wire harness side are connected to each other, in a conventional electric pump. As illustrated in FIG. 11, terminal holes 102 are formed in the flange 101. In a bottom portion of each of the terminal holes 102, a male terminal 103 is accommodated. At a fore-end of a wire harness 104, female terminals 105 are provided. Each of the female terminals 105 is inserted into the terminal hole 102 to be fitted to the male terminal 103 which is present in the bottom portion of the terminal hole 102. As a result, the wire harness 104 is connected to the power supply. A rubber grommet 106 is provided to a base portion of the female terminal 105. When the female terminal 105 is fitted to the male terminal 103 to be connected thereto, the rubber grommet 106 is inserted into the terminal hole 102. As a result, the female terminal 105 is connected to the male terminal 103 in the terminal hole 102 while being retained by the rubber grommet 106. The terminal hole 102 is sealed by the rubber grommet 106. In this manner, a portion at which the male terminal 103 and the female terminal 105 are connected to each other is also sealed without being externally exposed.

However, in the fuel supply device including the electric pump as described above, if the electric pump is vibrated due to vibrations or impact while a vehicle is running to accidentally disconnect the female terminal 105 from the male terminal 103, there is a fear in that the rubber grommet 106 may slip out of the terminal hole 102 along with the disconnection of the female terminal 105, as indicated by a broken line in FIG. 11. If the rubber grommet 106 slips out of the terminal hole 102 as illustrated in FIG. 11, the female terminal 105 is no longer retained by the rubber grommet 106. As a result, the female terminal 105 is placed in a loosely-fitted state. Moreover, if the rubber grommet 106 slips out of the terminal hole 102, the terminal hole 102 is placed in an open state. As a result, there is a fear that sealability and insulation properties of the vicinity of the male terminal 103 and the female terminal 105 may be degraded.

SUMMARY OF THE INVENTION

The present invention has an object to prevent a grommet used for sealing from slipping out in a wire-harness connecting portion of a fuel supply device.

According to an aspect of the present invention, a fuel supply device is arranged in a fuel tank for storing a fuel obtained by mixing alcohol and gasoline in an arbitrary proportion. The fuel supply device provided with an electric pump device driven by an electric motor includes: a case member for housing and retaining the electric pump device therein; a first power-feeding terminal accommodated in a terminal hole formed in the case member; a second power-feeding terminal provided to a feeder wiring electrically connected to the electric motor, the second power-feeding terminal being connected to the first power-feeding terminal in the terminal hole; and a grommet provided adjacent to the second power-feeding terminal, the grommet being fitted into the terminal hole to be located in the terminal hole when the first power-feeding terminal and the second power-feeding terminal are connected to each other, the grommet being retained in the terminal hole even when the second power-feeding terminal is disconnected from the first power-feeding terminal.

According to the aspect of the present invention, even if the second power-feeding terminal of the electric pump device is disconnected from the first power-feeding terminal due to vibrations, impact, or the like, the grommet is retained in the terminal hole. Specifically, even if the first power-feeding terminal and the second power-feeding terminal are disconnected from each other, the grommet does not slip out of the terminal hole. Therefore, the support of the second power-feeding terminal is ensured. In addition, sealability and insulation properties of a terminal connection portion are ensured. Therefore, even when the fuel supply device is placed in a fuel containing a large amount of water, the terminals can be prevented from corroding because the grommet serving as a sealing member is unlikely to slip out.

According to another aspect of the present invention, a fuel supply device is arranged in a fuel tank for storing a fuel obtained by mixing alcohol and gasoline in an arbitrary proportion. The fuel supply device provided with an electric pump device driven by an electric motor includes: a case member for housing and retaining the electric pump device therein; a first power-feeding terminal accommodated in a terminal hole formed in the case member; a second power-feeding terminal provided to a feeder wiring electrically connected to the electric motor, the second power-feeding terminal being connected to the first power-feeding terminal in the terminal hole; and a grommet provided adjacent to the second power-feeding terminal, the grommet including a sealing portion to be fitted into the terminal hole. A distance L1 from an end of the sealing portion on a side of the second power-feeding terminal to a fore-end of the second power-feeding terminal is smaller than a distance L2 from a fore-end of the first power-feeding terminal to an opening of the terminal hole (L1<L2).

According to the another aspect of the present invention, the sealing portion, the first power-feeding terminal, the second power-feeding terminal, the opening of the terminal hole, and the like of the electric pump device are set to have the above-mentioned relation. As a result, the grommet is retained in the terminal hole even when the second power-feeding terminal is disconnected from the first power-feeding terminal. Therefore, even if the second power-feeding terminal is disconnected from the first power-feeding terminal due to the vibrations, the impact, or the like, the support of the second power-feeding terminal can be ensured while the sealability and the insulation properties of the portion at which the terminals are connected to each other are ensured. Thus, even if the fuel supply device is placed in the fuel containing a large amount of water, the terminals can be prevented from corroding because the grommet serving as the sealing member is unlikely to slip out.

In the fuel supply device, the terminal hole may have a rotation-restraining fitting portion into which the second power-feeding terminal is inserted while rotation thereof being restrained, before the grommet is fitted into the terminal hole.

Further, the fuel supply device may further include a stopper for restricting axial movement of the grommet accommodated in the terminal hole, the stopper being attached to the case member so as to cover the opening of the terminal hole. The stopper may include: a cap portion having one end being inserted into the terminal hole; a base portion to which another end of the cap portion is connected; an attachment piece having flexibility and formed on the base portion; and an engagement hole formed through the attachment piece, the engagement hole being fitted to a projection formed on the case member when the cap portion is inserted into the terminal hole.

DETAILED DESCRIPTION OF THE PREFERRED EMBODIMENTS

Hereinafter, exemplary embodiments of the present invention are described in detail with reference to the accompanying drawings.

First Embodiment

Figure 1:
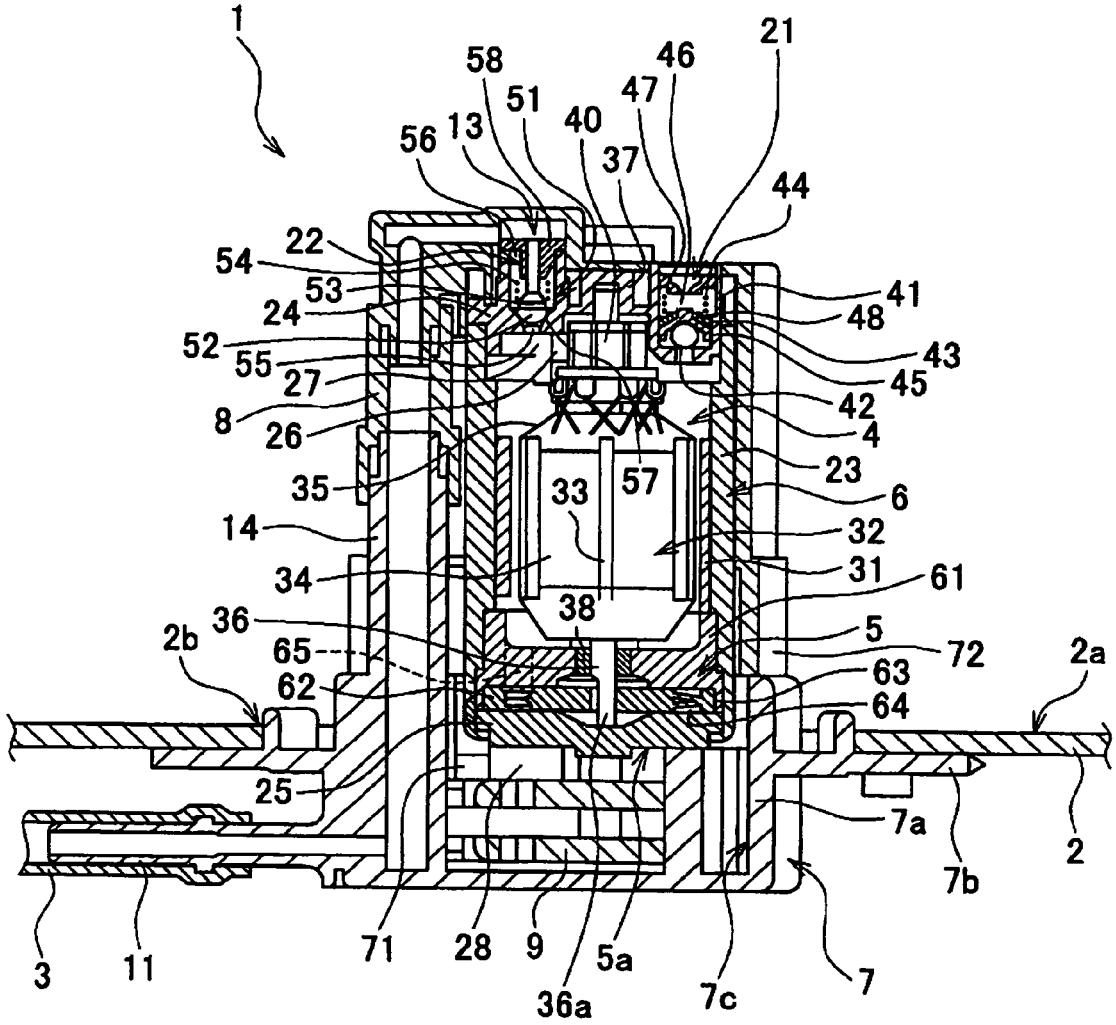
FIG. 1 is a sectional view illustrating a structure of a fuel supply device corresponding to a first embodiment of the present invention.

FIG. 1 is a sectional view illustrating a structure of a fuel supply device using an electric pump device, which corresponds to a first embodiment of the present invention. A fuel supply device 1 illustrated in FIG. 1 is a device for a two-wheel motor vehicle. A fuel tank 2 stores a fuel obtained by mixing alcohol and gasoline in an arbitrary proportion. The fuel supply device 1 is mounted to the fuel tank 2 by being inserted upward from a bottom of the fuel tank 2. The fuel supply device 1 is connected to a fuel supply system (not shown) of an engine to supply the fuel to a fuel injection valve of the engine through a fuel pipe 3.

The fuel supply device 1 includes a pump assembly (electric pump device) 6 obtained by integrating an electric motor 4, a fuel pump (pump) 5, and the like. The pump assembly 6 is housed in a flange unit (case member) 7. An upper cup 8 is mounted onto the pump assembly 6 housed in the flange unit 7. In the pump assembly 6, the fuel pump 5 is provided on the side of one end of the electric motor 4. On the side of another end of the electric motor 4, an outlet cover (cover member) 24 including a pressure regulator 21 for regulating a fuel pressure and a check valve 22 for preventing a backflow of the fuel is provided.

Figure 2:
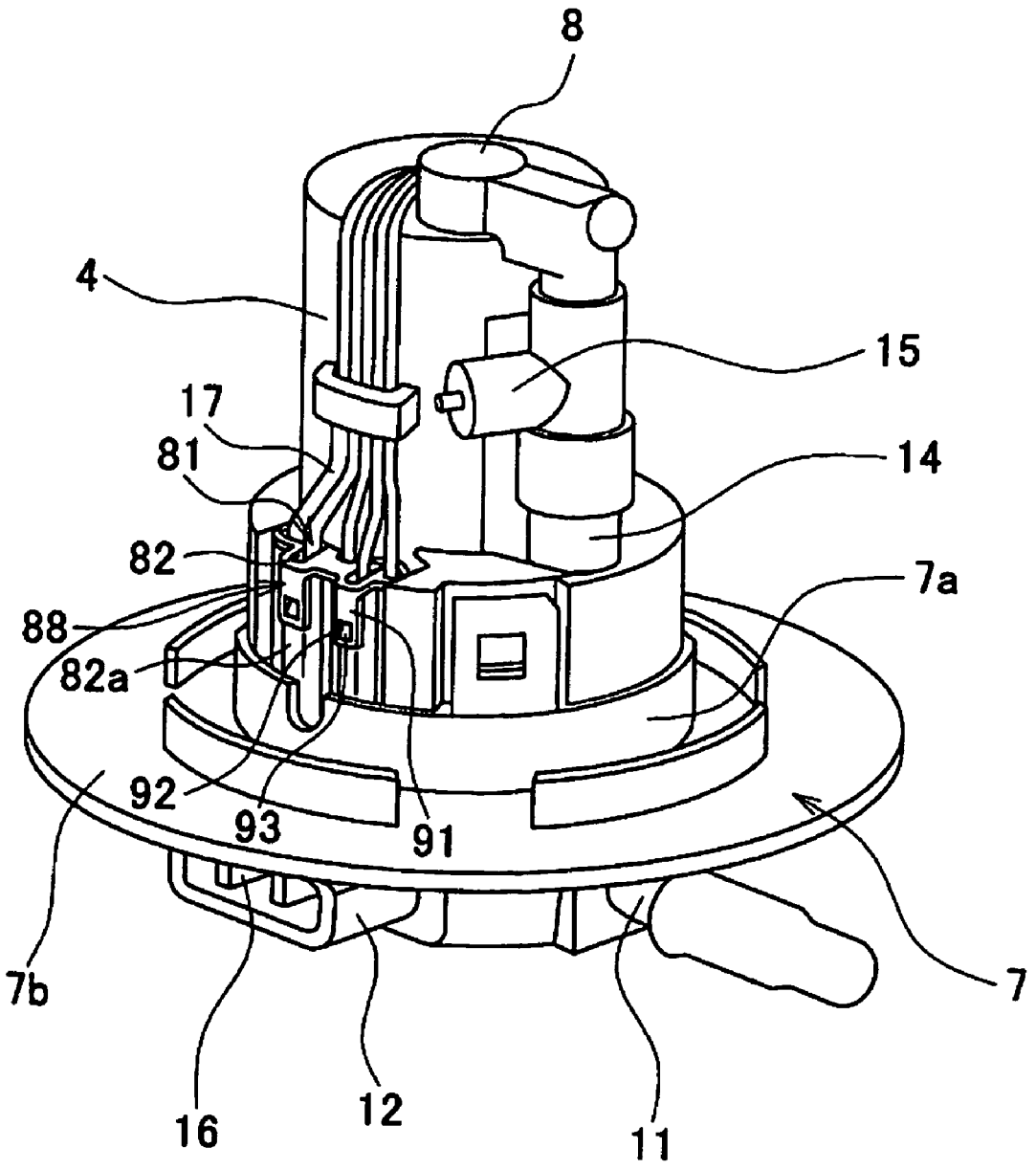
FIG. 2 is a perspective view illustrating a state where a pump assembly is mounted into a flange unit and an upper cup is mounted onto the pump assembly.

The flange unit 7 includes a cylindrical case portion 7*a* and a flange portion 7*b*. Inside the case portion 7*a*, a filter 9 is provided. The pump assembly 6 is located above the pump assembly 6. FIG. 2 is a perspective view illustrating a state where the pump assembly 6 is mounted into the flange unit 7 and the upper cup 8 is mounted onto the pump assembly 6. In the state illustrated in FIG. 2, the fuel supply device 1 is inserted into the fuel tank 2 through a pump attachment hole 2*b* which is formed through a bottom surface 2*a* of the fuel tank 2. For mounting the fuel supply device 1 into the fuel tank 2, the flange portion 7*b* is fixed to the bottom of the fuel tank 2 by a bolt and a nut (not shown).

An outlet pipe 11 and a power connector 12 are provided to a lower end of the flange unit 7. The fuel pipe 3 is connected to the outlet pipe 11. The outlet pipe 11 is connected to a fuel discharge port 13 of the pump assembly 6 through an intermediation of a communication pipe 14. A relief valve 15 for regulating the fuel pressure in the fuel pipe 3 is provided to the communication pipe 14. Supply terminals 16 are provided inside the power connector 12. The supply terminals 16 are connected to a harness (a set of feeder wirings) 17 at a terminal connection portion 81. The harness 17 extends upward on the lateral side of the pump assembly 6 to be electrically connected to the electric motor 4 at the upper end of the pump assembly 6.

Figure 3:
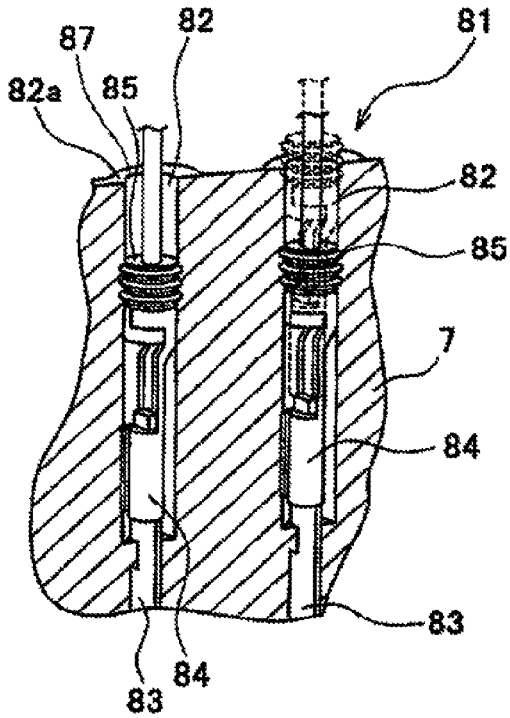
FIG. 3 is an explanatory view illustrating a structure of a terminal connection portion.

FIG. 3 is an explanatory view illustrating a structure of the terminal connection portion 81. As illustrated in FIG. 3, terminal holes 82 which extend vertically in FIG. 1 are formed in the flange unit 7. In a bottom portion of each of the terminal holes 82, a male terminal (first power-feeding terminal) 83 which is electrically connected to each of the supply terminals 16 is accommodated. At a fore-end of the harness 17, female terminals (second power-feeding terminals) 84 are provided. Each of the female terminals 84 is inserted into the terminal hole 82 to be fitted to the male terminal 83 which is present in the bottom portion of the terminal hole 82. In this manner, the harness 17 is connected to the supply terminals 16.

At a base portion of each of the female terminals 84, a rubber grommet 85 is provided. On an outer circumference of the rubber grommet 85, a sealing portion 86 having a plurality of concavities and convexities is formed. When the female terminal 84 is fitted to the male terminal 83 to be connected thereto, the rubber grommet 85 is inserted into the terminal hole 82 to bring the sealing portion 86 into close contact with an inner wall of the terminal hole 82. As a result, the female terminal 84 is connected to the male terminal 83 in the terminal hole 82 while being retained by the rubber grommet 85. Moreover, an opening 87 of the terminal hole 82 is closed by the rubber grommet 85 to achieve a hermetically-sealed state. Therefore, the male terminal 83 and the female terminal 84 are both accommodated in the terminal hole 82 without being externally exposed. A portion at which the male terminal 83 and the female terminal 84 are connected to each other is sealed in an insulated state.

Figure 11:
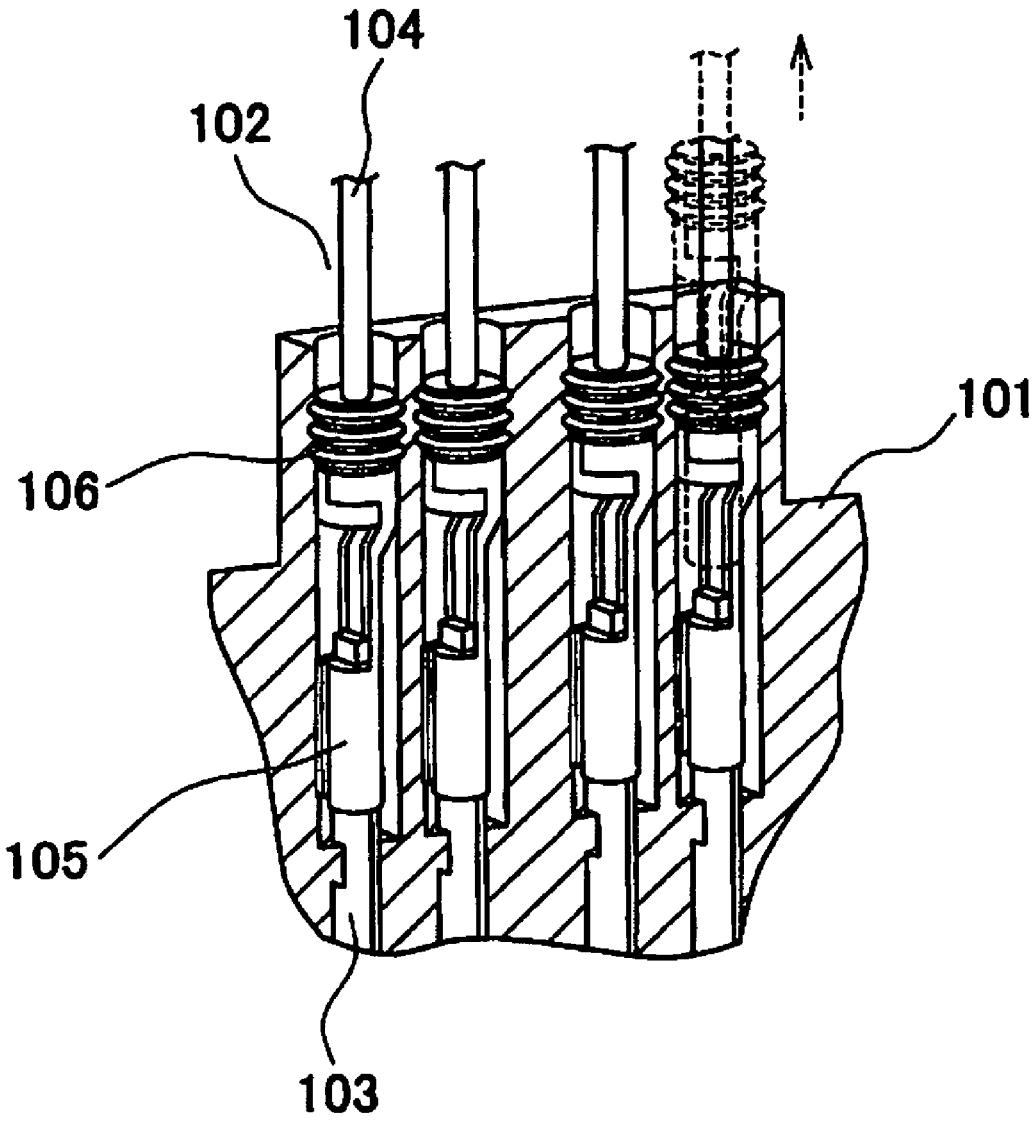
FIG. 11 is an explanatory view illustrating a structure of a conventional terminal connection portion.

Here, in the structure of the conventional terminal connection portion illustrated in FIG. 11, when the female terminal 84 is disconnected from the male terminal 83 due to vibrations of a vehicle or the like, there is a fear in that the rubber grommet 85 slips out of the terminal hole 82 to impair sealability, as described above. On the other hand, in the fuel supply devise 1 of the present invention, a distance between the female terminal 84 and the rubber grommet 85 is smaller than that between the opening 87 of the terminal hole 82 and a fore-end of the male terminal 83. Therefore, as indicated by a broken line in FIG. 3, even if the female terminal 84 is disconnected from the male terminal 83, the rubber grommet 85 does not slip out of the terminal hole 82.

Figure 4:
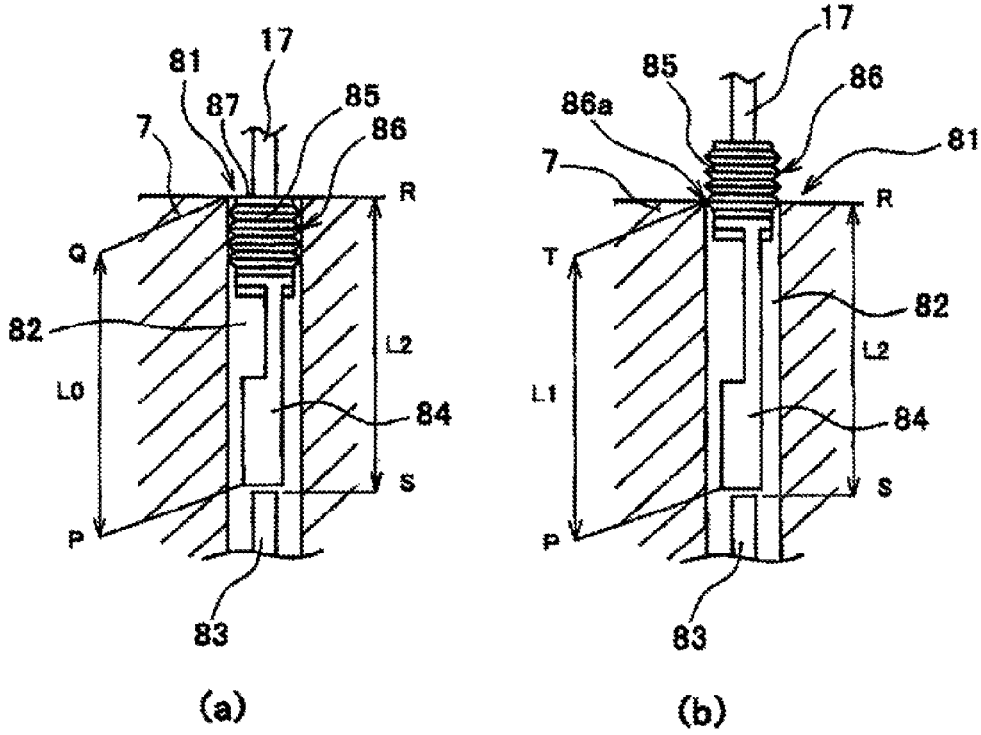
FIGS. 4A and 4B are explanatory views, each illustrating a relation between a male terminal and a female terminal, and a rubber grommet in the terminal connection portion.

Specifically, in the fuel supply device 1, a distance L0 from a fore-end P of the female terminal 84 to a rear end Q of the rubber grommet 85 (end of the rubber grommet 85 on the side opposite to the female terminal 84) is smaller than a distance L2 from a position R of the opening 87 of the terminal hole 82 to a fore-end S of the male terminal 83 ($L0 \leqq L2$). With such dimensional setting, the whole rubber grommet 85 remains in the terminal hole 82 even in the state where the female terminal 84 is disconnected from the male terminal 83, as illustrated in FIG. 4A. The female terminal 84 is retained in the terminal hole 82 while being supported by the rubber grommet 85. Specifically, the dimensions are set so that the female terminal 84 is disconnected from the male terminal 83 before the rubber grommet 85 slips out of the terminal hole 82. Moreover, even if the female terminal 84 is disconnected from the male terminal 83, the opening 87 is not placed in an open state. Thus, a sealed state of the portion at which the male terminal 83 and the female terminal 84 are connected to each other is ensured.

On the other hand, in the above-mentioned setting, the structure is such that the whole rubber grommet 85 remains in the terminal hole 82 when the terminals 83 and 84 are disconnected from each other. In view of ensured sealability, however, the dimensions may also be set so that at least a part of the sealing portion 86 (convex portion 86*a*) of the rubber grommet 85 remains in the terminal hole 82. In this case, as illustrated in FIG. 4B, a distance L1 from the fore-end P of the female terminal 84 to the convex portion 86*a* (position T; end of the sealing portion 86) on the side of the forward-most end (end on the side of the female terminal 84) of the rubber grommet 85 is set smaller than the distance L2 from the position R of the opening 87 of the terminal hole 82 to the fore-end S of the male terminal 83 ($L1<L2$). Specifically, a condition illustrated in FIG. 4B, which allows at least a part of the sealing portion 86 of the rubber grommet 85 to remain in the terminal hole 82, is a minimum condition of the dimensional setting. The condition which allows the whole rubber grommet 85 to remain in the terminal hole 82 is the most reliable condition of the dimensional setting.

As described above, the sealing portion 86 of the rubber grommet 85, the female terminal 84, the male terminal 83, the opening 87 of the terminal hole 82, and the like are set to have the above-mentioned relation. As a result, even if the female terminal 84 is disconnected from the male terminal 83 due to the vibrations of the vehicle or the like, the rubber grommet 85 can be retained in the terminal hole 82. Therefore, even if the female terminal 84 is disconnected from the male terminal 83 due to the vibrations, the impact, or the like, the support of the female terminal 84 and the sealability and insulation properties of the portion at which the male terminal 83 and the female terminal 84 are connected to each other can be ensured. Therefore, even when the fuel supply device 1 is placed in the fuel containing a large amount of water such as a fuel blended with an alcohol component such as ethanol, the rubber grommet 85 is unlikely to slip out of the terminal hole 82. Accordingly, the terminals 83 and 84 can be prevented from corroding. Moreover, the terminal holes 82 are provided independently of each other in the fuel supply device 1, and hence the insulation properties between the terminals can be ensured.

Figure 5:
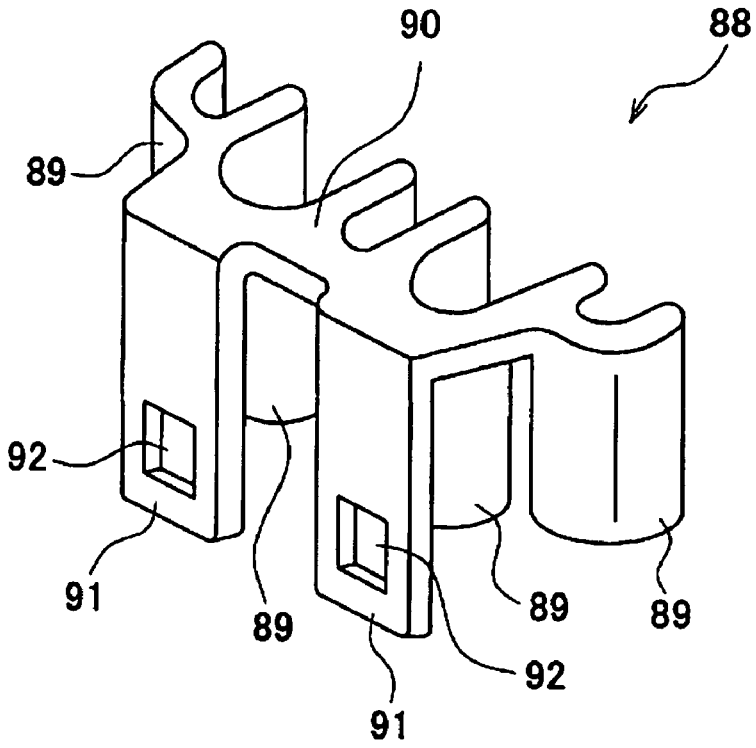
FIG. 5 is a perspective view illustrating a structure of a stopper.
Figure 6:
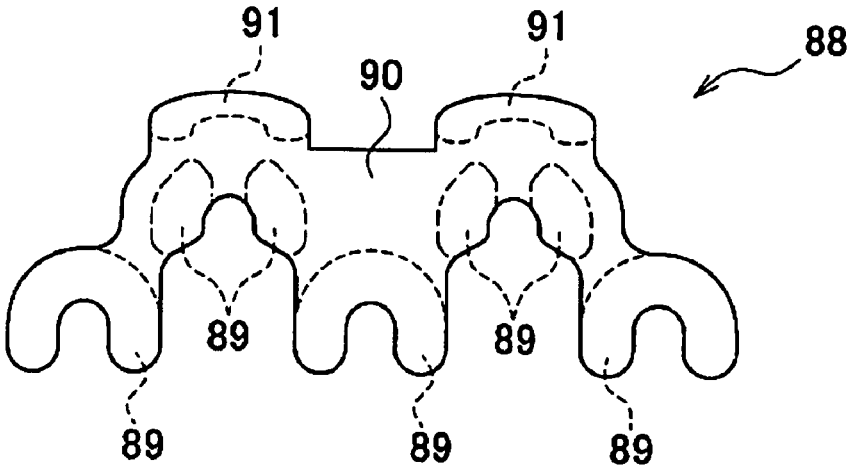
FIG. 6 is a plan view of the stopper.
Figure 7:
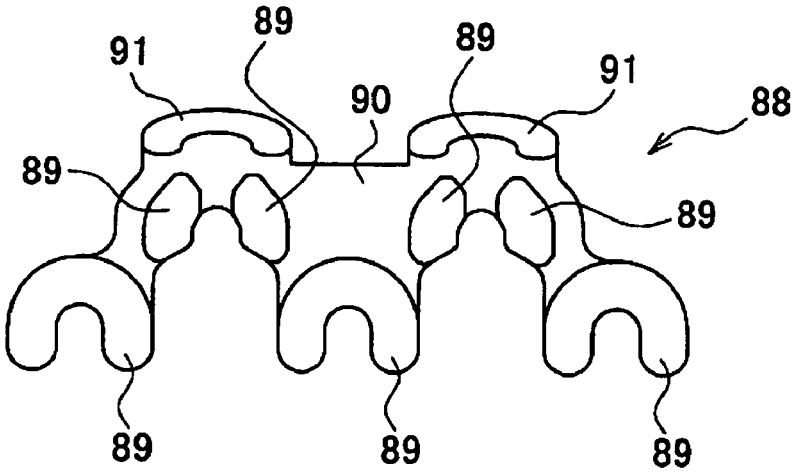
FIG. 7 is a bottom view of the stopper.
Figure 8:
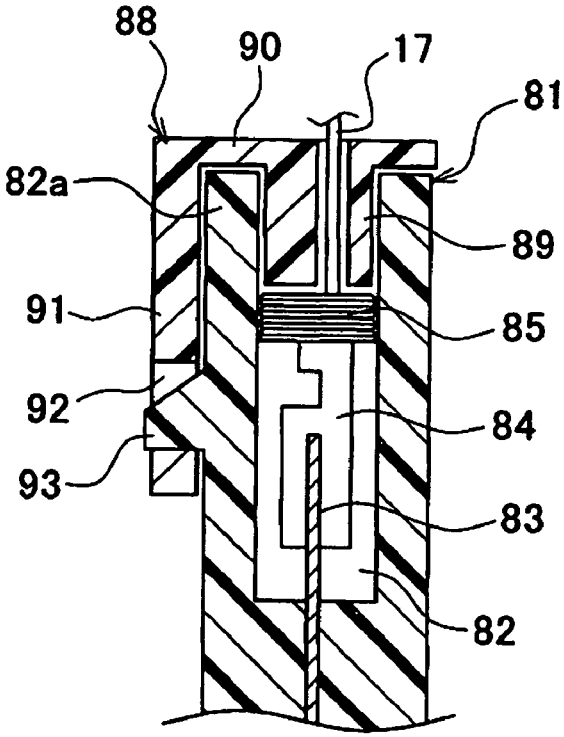
FIG. 8 is an explanatory view illustrating a state where the stopper is attached to the terminal connection portion.

Moreover, in the fuel supply device 1 of the present invention, a stopper 88 for retaining the female terminal 84 is attached to the terminal connection portion 81. FIG. 5 is a perspective view illustrating a structure of the stopper 88, FIG. 6 is a plan view of the stopper 88, FIG. 7 is a bottom view of the stopper 88, and FIG. 8 is an explanatory view illustrating a state where the stopper 88 is attached to the terminal connection portion 81. The stopper 88 is made of a synthetic resin having a high oil resistance such as polyacetal. As illustrated in FIG. 2, the stopper 88 is mounted to the flange unit 7 so as to cover the openings 87 of the terminal holes 82.

As illustrated in FIGS. 5 to 7, the stopper 88 is provided with cylindrical wall-like cap portions 89. An end of each of the cap portions 89 is inserted into each of the terminal holes 82. Another end of each of the cap portions 89 is connected to a base portion 90. Each of the cap portions 89 is provided upright on the base portion 90. In the stopper 88, the cap portions 89 are connected to each other through the base portion 90, thereby ensuring a stiffness of the stopper 88 as a whole. Attachment pieces 91 having flexibility are provided to the front side of the base portion 90 (on the left side in FIG. 5, and the upper side in FIGS. 6 and 7). The attachment pieces 91 are formed on front surfaces of the gap portions 89 in a cantilever fashion at a distance from the cap portions 89. As illustrated in FIG. 8, the attachment pieces 91 are placed outside outer walls 82*a* of the terminal holes 82 when the cap portions 89 are respectively inserted into the terminal holes 82.

An engagement hole 92 is formed in a lower part of each of the attachment pieces 91. When the cap portions 89 are respectively inserted into the terminal holes 82, projections 93 formed on the outer walls 82*a* are respectively fitted into the engagement holes 92 while the attachment pieces 91 are elastically flexed. Specifically, the stopper 88 is attached and fixed to the terminal connection portion 81 by snap-fitting using the attachment pieces 91. As a result, the axial movement (movement in a direction in which the terminal holes 82 extend; in a vertical direction illustrated in FIG. 3) of the rubber grommets 85 respectively accommodated in the terminal holes 82 is restricted. Therefore, even if the female terminal 84 is disconnected from the male terminal 83 due to the vibrations of the vehicle or the like, the rubber grommet 85 can be prevented from slipping out of the terminal hole 82. In the fuel supply device 1 according to the present invention, the rubber grommet 85 is further prevented from slipping out of the terminal hole 82 by using the stopper 88.

When the stopper 88 is attached to the terminal connection portion 81, the cap portions 89 are respectively inserted in the terminal holes 82. As illustrated in FIG. 8, a gap (for example, about 0.5 mm) is formed between a lower end of each of the cap portions 89 and the rubber grommet 85. In this manner, direct abutment between the rubber grommet 85 and the cap portion 89 can be avoided. Therefore, the rubber grommet 85 is not deformed by the cap portion 89, and hence the sealability provided by the rubber grommet 85 is ensured. Moreover, the stopper 88 is attached to the terminal connection portion 81 in the state where the cap portions 89 are inserted in the terminal holes 82. Therefore, even if the harness 17 is pulled, the cap portions 89 abut against the inner walls of the terminal holes 82 to regulate the movement of the female terminals 84. Accordingly, the female terminals 84 are unlikely to be disconnected from the male terminals 83, thereby further enhancing the retention effects provided by the stopper 88.

In the flange unit 7, a bottom portion of the case portion 7*a* serves as a reservoir portion 71. The reservoir portion 71 is placed below the bottom surface 2*a* of the fuel tank 2. A fuel inlet hole 72 is formed on a side surface of the upper cup 8. The fuel flows through the fuel inlet hole 72 into the reservoir portion 71. The filter 9, which is folded in the middle, is provided in the reservoir portion 71. The fuel flowing to be stored in the reservoir portion 71 is sucked by the fuel pump 5 through the filter 9.

The pump assembly 6 includes the electric motor 4, the fuel pump 5, the pressure regulator 21, and the check valve 22, which are integrally housed within a shell case 23 made of steel. The outlet cover 24 and an inlet cover 25 are respectively fixed to the ends of the cylindrical shell case 23 by caulking. The outlet cover 24 is made of a synthetic resin and is mounted to one end of the shell case 23.

A brush holder portion 27 for holding a brush 26 of the electric motor 4 is provided to the outlet cover 24. Specifically, the outlet cover 24 serves as a cover of the shell case 23 and also as the brush holder of the electric motor 4. The pressure regulator 21 and the check valve 22 are provided inside the outlet cover 24. The check valve 22 is provided to the fuel discharge port 13. An end of the check valve 22 is connected to the communication pipe 14 in communication therewith. An end of the pressure regulator 21 is open in the fuel tank 2.

The inlet cover 25 is formed by die-casting of aluminum and is mounted to another end side of the shell case 23. A fuel inlet portion 28 is provided in a projecting manner on the lowed end side of the inlet cover 25. The filter 9 is provided to the outer side of the fuel inlet portion 28. The filter 9 is formed to have an approximately rectangular shape as a whole. The filter 9 is provided in the case portion 7*a* of the flange unit 7 while being folded in a C-like shape.

The electric motor 4 is a DC motor with a brush. The shell case 23 also serves as a yoke of the electric motor 4. A plurality of permanent magnets 31 are fixed onto an inner circumferential surface of the shell case 23. An armature 32 is rotatably provided on the inner side of the permanent magnets 31. The armature 32 includes: a core 34 including a plurality of axially extending slots 33; and a winding 35 wound around the core 34 so as to pass along the slots 33. The armature 32 is fixed to a rotating shaft 36. The armature 32 is rotatably supported between a bearing portion 37 provided to the outlet cover 24 and a bearing 38 provided to a pump case 61. Above the armature 32 in FIG. 1, a commutator 40 is provided. The commutator 40 is fixed to the rotating shaft 36. The brush 26 is in abutment against the commutator 40 in a radial direction.

The pressure regulator 21 includes: an armature 43 including a ball (steel ball) 42; and a valve spring 44. The armature 43 and the valve spring 44 are accommodated in a regulator accommodating portion 41 formed inside the outlet cover 24. The regulator accommodating portion 41 has a minor-diameter portion 45 on the upstream side (lower side in FIG. 1) and a major-diameter portion 46 on the downstream side. A valve surface is formed at the boundary between the minor-diameter portion 45 and the major-diameter portion 46. The valve surface is obtained by plastically deforming an edge of the boundary portion between the minor-diameter portion 45 and the major-diameter portion 46 with punching. When the ball 42 comes into close contact with the valve surface, the pressure regulator 21 is placed in a valve-closed state. A retainer 47 is pressed into and fixed to an end of the major-diameter portion 46 on the downstream side. The retainer 47 is formed to have an approximately ring-like shape. One end of the valve spring 44 is in abutment against the upstream side (lower end surface) of the retainer 47.

A coil spring is used as the valve spring 44. Another end of the valve spring 44 is in abutment against a spring holder 48 of the armature 43. The ball 42 is normally in pressure contact with the valve surface by a biasing force of the valve spring 44 (valve-closed state). When a fluid pressure is applied from the minor-diameter portion 45 side to become larger than the biasing force of the valve spring 44, the ball 42 is moved upward to generate a gap between the valve surface and the ball 42. As a result, the pressure regulator 21 is placed in a valve-open state. Specifically, when a fuel pressure in the shell case 23 exceeds a predetermined regulating pressure, the fuel pressure is applied to the armature 43 to move upward the armature 43. As a result, an excessive fuel is returned to the fuel tank 2. When the fluid pressure is lowered and the biasing force of the valve spring 44 becomes larger than the fluid pressure, the ball 42 is moved downward by the biasing force of the valve spring 44 to come into abutment against the valve surface. When the ball 42 abuts against the valve surface, the minor-diameter portion 45 is closed. As a result, the pressure regulator 21 is placed in the valve-closed state.

The check valve 22 includes: a valve 53 having a semi-spherical sealing portion 52 at one end; and a valve spring 54. The valve 53 and the valve spring 54 are accommodated in a check valve accommodating portion 51 formed inside the outlet cover 24. Similarly to the regulator accommodating portion 41, the check valve accommodating portion 51 includes a minor-diameter portion 55 on the upstream side and a major-diameter portion 56 on the downstream side. A tapered surface 57 is formed in a boundary portion between the minor-diameter portion 55 and the major-diameter portion 56. When the sealing portion 52 comes into abutment against the tapered surface 57, the check valve 22 is placed in a valve-closed state. A valve guide 58 is fixed by caulking to an end of the major-diameter portion 56 on the downstream side. One end of the valve spring 54 is in abutment against the upstream side (lower end surface) of the valve guide 58.

A coil spring is used even for the valve spring 54. Another end of the valve spring 54 is in abutment against the valve 53. The sealing portion 52 of the valve 53 is normally in pressure contact with the tapered surface 57 by the biasing force of the valve spring 54 (valve-closed state). When the fluid pressure is applied from the minor-diameter portion 55 side to become larger than the biasing force of the valve spring 54, the valve 53 is moved upward to generate a gap between the tapered surface 57 and the sealing portion 52. As a result, the check valve 22 is placed in a valve-open state. When the fuel pump 5 is operated to cause the fuel to be supplied from the minor-diameter portion 55 side, the check valve 22 is opened by the pressure of the fuel to supply the fuel to the fuel pipe 3. When the fuel pump 5 is stopped to lower the fluid pressure, the biasing force of the valve spring 54 becomes larger than the fluid pressure. As a result, the valve 53 is moved downward by the biasing force of the valve spring 54. When the valve 53 is moved downward, the sealing portion 52 comes into abutment against the tapered surface 57 to close the minor-diameter portion 55. As a result, the check valve 22 is placed in the valve-closed state. When the check valve 22 is closed, the fuel can be prevented from reversely flowing from the fuel pipe 3 to the fuel pump 5.

The fuel pump 5 is a non-positive displacement type regenerative pump and includes the pump case 61 and an impeller 62. On the lower end side of the pump case 61, a cylindrical impeller accommodating portion 63 is provided in a concave manner. The impeller 62 connected to the rotating shaft 36 of the electric motor 4 is provided in the impeller accommodating portion 63. A D-shaped portion 36*a* is formed on the rotating shaft 36. The impeller 62 is mounted to the D-shaped portion 36*a* to rotate integrally with the rotating shaft 36. In an area of the impeller 62 on the side closer to the outer periphery thereof, a plurality of pump chambers 64 are provided along a circumferential direction.

The fuel inlet portion 28 is provided to the inlet cover 25 so as to correspond to the pump chambers 64. As described above, in a pre-stage of the fuel inlet portion 28, the filter 9 is located. A communication hole 65 is provided on the upper end side of the impeller accommodating portion 63 so as to correspond to the pump chambers 64. The communication hole 65 is open in the shell case 23 to be faced thereto. When the electric motor 4 is driven to operate the rotating shaft 36, the impeller 62 is rotated in the fuel pump 5. With the rotation of the impeller 62, the fuel is sucked into the pump chambers 64 from the fuel inlet portion 28. The fuel supplied to the pump chambers 64 is delivered through the communication hole 65 into the shell case 23 by the rotation of the impeller 62. The fuel in the shell case 23 is supplied to the fuel pipe 3 through the check valve 22.

The fuel supply device 1 functions as follows. First, when the electric motor 4 is driven to operate the fuel pump 5, the fuel in the fuel tank 2 passes through the fuel inlet hole 72 to flow into the reservoir portion 71. The fuel in the reservoir portion 71 is sucked into the fuel inlet portion 28 through the filter 9. In the fuel pump 5, the impeller 62 rotates with the rotating shaft 36. With the rotation of the impeller 62, the fuel is sucked from the fuel inlet portion 28 into the pump chambers 64. The fuel supplied to the pump chambers 64 is delivered to the shell case 23 by the rotation of the impeller 62. The fuel in the shell case 23 is supplied from the fuel discharge port 13 to the fuel pipe 3 through the check valve 22.

When the fuel pressure exceeds the predetermined regulating pressure along with the pumping operation, the pressure regulator 21 is placed in the valve-open state. When the pressure regulator 21 is opened, the fuel in the shell case 23 is returned to the fuel tank 2. As a result, the pressure of the fuel supplied to the fuel pipe 3 side is appropriately regulated. As described above, the fuel pipe 3 is connected to the fuel injection valve of the engine. The fuel sucked from the fuel tank 2 by the fuel supply device 1 is supplied to the fuel injection valve through the fuel pipe 3.

Second Embodiment

Figure 9:
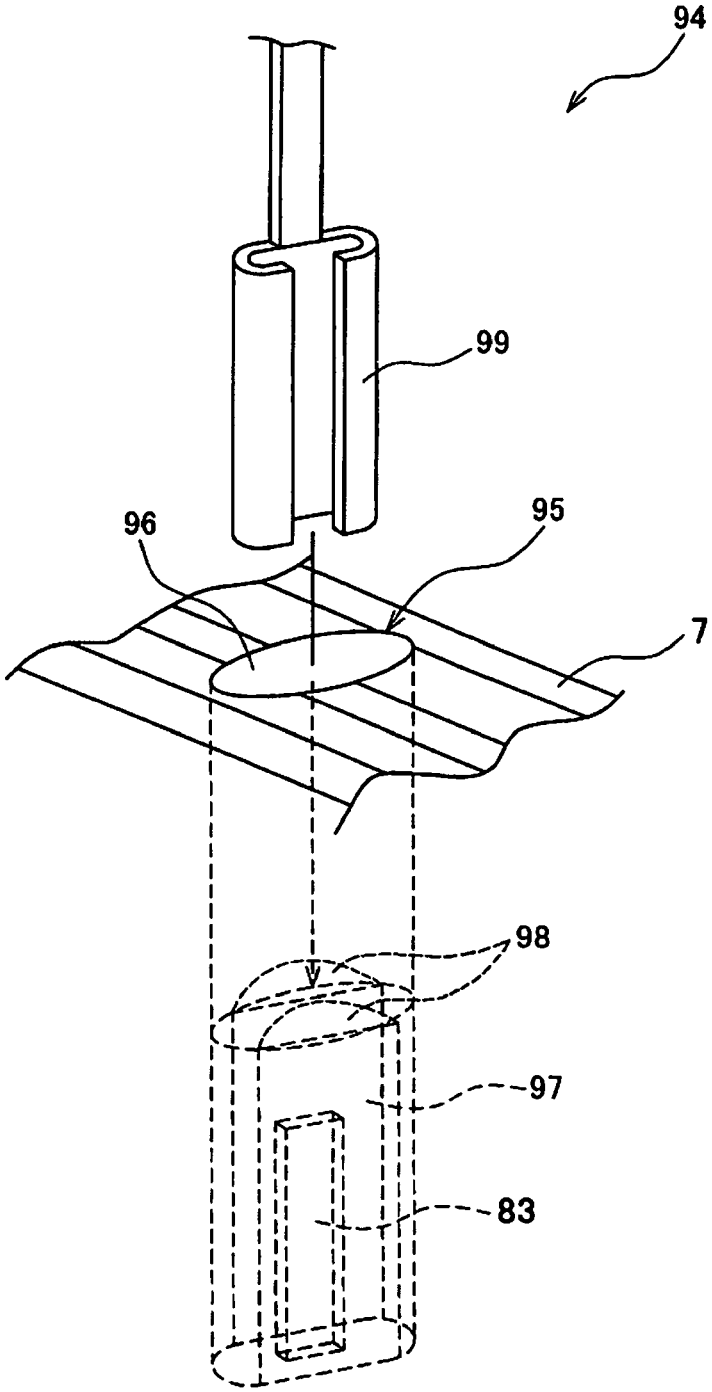
FIG. 9 is an explanatory view illustrating a structure of a terminal connection portion of a fuel supply device corresponding to a second embodiment of the present invention.
Figure 10:
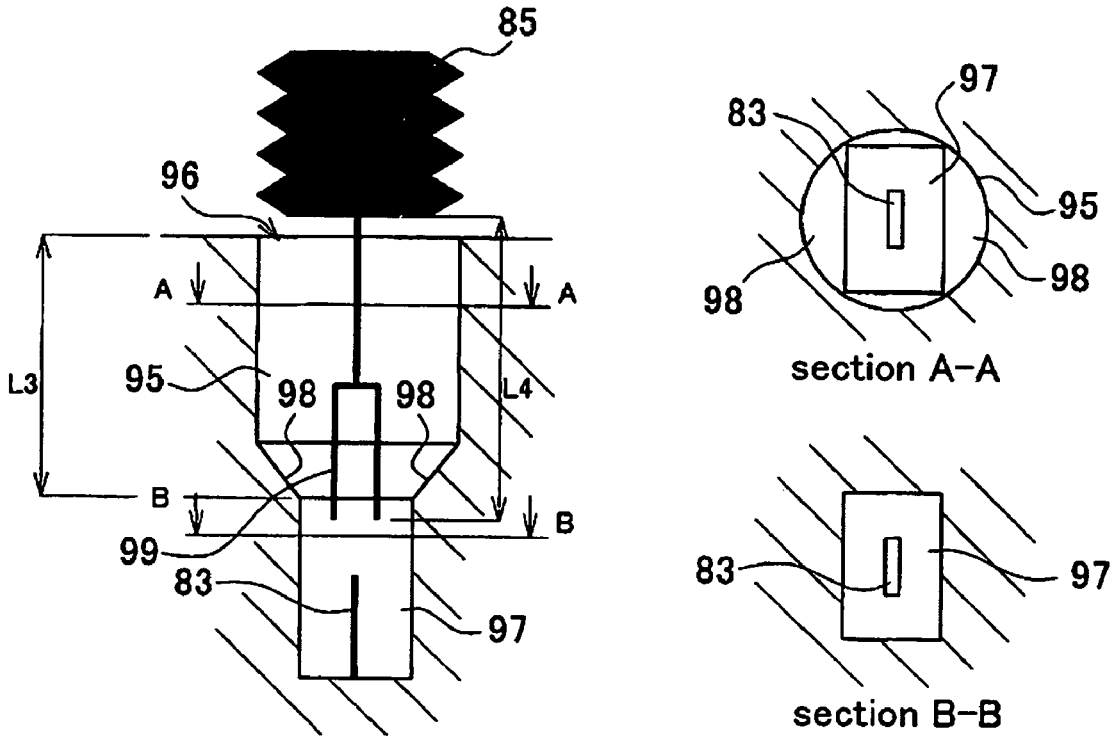
FIG. 10 is an explanatory view illustrating a relation between a terminal hole, a rubber grommet, and a male terminal in the terminal connection portion illustrated in FIG. 9.

Next, the fuel supply device corresponding to a second embodiment of the present invention is described. FIG. 9 is an explanatory view illustrating a structure of the terminal connection portion in the fuel supply device according to the second embodiment. FIG. 10 is an explanatory view illustrating a relation between the terminal hole, and the rubber grommet and the male terminal in the terminal connection portion according to the second embodiment. The structure of the second embodiment other than that of the terminal connection portion is similar to that of the fuel supply device 1 according to the first embodiment. The same components and parts as those of the first embodiment are denoted by the same reference numerals, and the description thereof is omitted.

As illustrated in FIGS. 9 and 10, a sectional shape of a terminal hole 95 differs in the vicinity of an opening 96 and in a bottom portion (rotation-restraining fitting portion) 97. In the vicinity of the opening 96, the terminal hole 95 has a circular cross section. In the bottom portion 97 in which the male terminal 83 is located, the terminal hole 95 has an approximately rectangular shape obtained by cutting a circumference with two opposed chords. On the opening side of the bottom portion 97, a tapered portion 98 is provided so as to have a diameter decreasing toward the bottom portion 97. A female terminal 99 is smoothly guided into the bottom portion 97 owing to the tapered portion 98. The female terminal 99 fitted to be connected to the male terminal 83 is formed to have a sectional shape conforming to the shape of the bottom portion 97. The bottom portion 97 is formed to have inner size which is slightly larger than outer size of the female terminal 99. When the female terminal 99 is connected to the male terminal 83, the female terminal 99 is loosely fitted into the bottom portion 97. The female terminal 99 is inserted into the bottom portion 97 while the rotation thereof is restrained.

By setting the shapes of the bottom portion 97 and the female terminal 99 as described above, the female terminal 99 is not rotated due to the vibrations or the like. Therefore, the female terminal 99 is unlikely to be disconnected from the male terminal 83. Thus, the reliable connection between the male terminal 83 and the female terminal 99 is ensured. Moreover, the female terminal 99 is fitted to the male terminal 83 while being guided to the bottom portion 97, and hence the male terminal 83 can be smoothly inserted into the female terminal 99, thereby improving operability. The dimensional setting of the rubber grommet 85 and the like is the same as that in the first embodiment. Thus, even if the female terminal 99 is disconnected from the male terminal 83, the rubber grommet 85 does not slip out of the terminal hole 82.

Further, in the fuel supply device 94, a distance L3 from the opening 96 to the bottom portion 97 is set smaller than a distance L4 from the fore-end of the male terminal 83 to the rubber grommet 85 (L3<L4). Therefore, when the female terminal 99 is to be fixed, the female terminal 99 is fitted into the bottom portion 97 before the rubber grommet 85 is fitted into the terminal hole 95.

As in the first embodiment, for connecting and fixing the female terminal 99, the setting is such that the rubber grommet 85 is fitted into the terminal hole 95 before the female terminal 99 and the male terminal 83 are connected to each other in the fuel supply device 94 according to the second embodiment. When the rubber grommet 85 is fitted into the terminal hole 95 for the connection between the female terminal 99 and the male terminal 83, the terminals become unlikely to rotate as a result of the fitting of the rubber grommet 85 into the terminal hole 95. Therefore, the positioning of the female terminal 99 with respect to the bottom portion 97 becomes difficult in some cases.

In order to cope with the problem described above, the above-mentioned dimensional relation (L3<L4) is adopted in the fuel supply device 94 according to the second embodiment. Therefore, even with the setting which causes the rubber grommet 85 to be fitted into the terminal hole 95 before the connection between the female terminal 99 and the male terminal 83, the female terminal 99 is fitted into the bottom portion 97 before the rubber grommet 85 is fitted into the terminal hole 95. Therefore, at the moment when the female terminal 99 is fitted into the bottom portion 97, the rotation of the female terminal 99 is restrained to complete the positioning between the terminals. Specifically, it is not necessary to rotate the terminals for the positioning when the terminals are to be connected to each other. Thus, even if the rubber grommet 85 is fitted into the terminal hole 95 before the connection between the terminals, an operation of connecting the terminals can be performed without being affected thereby. Even in this regard, the operability is improved.

It is apparent that the present invention is not limited to the embodiments described above and various changes are possible without departing from the scope of the present invention.

In the above-mentioned embodiments, the sealing portion 86 of the rubber grommet 85 has the convexo-concave structure with alternately provided convexities and concavities. However, the structure of the sealing portion is not limited thereto. For example, the structure may also be such that the rubber grommet 85 is pressed into the terminal hole 82. In this case, the entire outer circumference of the rubber grommet 85 may serve as the sealing portion. Moreover, the number of terminals (four in the embodiments) in the terminal connection portion 81 is merely an example, and therefore, the number of terminals is not particularly limited. Further, the relation between the male terminals and the female terminals is not limited to that described above. The terminals provided on the harness 17 side may be male terminals, whereas the terminals provided on the terminal hole 82 side may be female terminals. Further, each of the bottom portion 97 and the female terminal 99 in the second embodiment may have any sectional shape as long as the female terminal 99 is loosely fitted into the bottom portion 97 so as to prevent the rotation of the female terminal 99. Therefore, the sectional shapes of the bottom portion 97 and the female terminal 99 are not limited to those illustrated in FIG. 9. For example, each of the bottom portion 97 and the female terminal 99 may have a polygonal shape such as a triangular or rectangular shape or an ellipsoidal shape. In addition, as in the case of the fuel supply device 1 according to the first embodiment, the stopper 88 may be attached even to the fuel supply device 94 according to the second embodiment so as to cover the openings 96 of the terminal holes 95.

On the other hand, although the example where the fuel supply device according to the present invention is used for the two-wheel motor vehicles has been described in the above-mentioned embodiments, the use of the fuel supply device according to the present invention is not limited thereto. The fuel supply device according to the present invention can also be used as a fuel supply device for various vehicles such as four-wheel motor vehicles. Moreover, the structure of the present invention is applicable not only to the fuel pump but also to a pump which supplies a liquid such as water or a chemical liquid or a gas such as air. Further, the structures of the electric motor 4 and the fuel pump 5 are not particularly limited. For example, the number of poles, the number of slots, the shape of the impeller, and the like can be appropriately set.

What is claimed is:

1. A fuel supply device arranged in a fuel tank for storing a fuel obtained by mixing alcohol and gasoline in an arbitrary proportion, the fuel supply device having an electric pump device driven by an electric motor, said fuel supply device comprising:

a case member having a terminal hole, and being configured to house and retain the electric pump device therein;

a first power-feeding terminal disposed in said terminal hole in said case member;

a second power-feeding terminal provided to a feeder wiring electrically connected to the electric motor, said second power-feeding terminal being configured to be connected to said first power-feeding terminal in said terminal hole;

a grommet adjacent to said second power-feeding terminal, said grommet comprising a sealing portion configured to be fitted into said terminal hole; and a stopper configured to restrict axial movement of said grommet fitted in said terminal hole, said stopper being attached to said case member so as to cover an opening of said terminal hole, wherein said grommet is fitted into said terminal hole so as to be located in said terminal hole when said first power-feeding terminal and said second power-feeding terminal are connected to each other, wherein said sealing portion is configured and arranged, such that an end of said sealing portion on a side of said second power-feeding terminal to a fore-end of said second power-feeding terminal defines a first distance L1, and said first power-feeding terminal is configured and arranged such that a fore-end of said first power-feeding terminal to an opening of said terminal hole defines a second distance L2, and the first distance is less than the second distance (L1<L2), so that said grommet is retained in said terminal hole when said second power-feeding terminal is disconnected from said first power-feeding terminal, and wherein said stopper comprises:

a cap portion having a first end and a second end, said first end being inserted into said terminal hole;

a base portion of said second end of said cap portion being connected to said base portion;

a flexible attachment piece disposed on said base portion; and an engagement hole extending through said flexible attachment piece, said engagement hole being fitted to a projection disposed on said case member when said cap portion is inserted into said terminal hole.

2. A fuel supply device according to claim 1, further comprising a rotation-restraining fitting portion disposed in said terminal hole, and said second power-feeding terminal is configured to be inserted into said rotation-restraining fitting portion so as to restrain rotation of said second power-feeding terminal before said grommet is fitted into said terminal hole.

* * * * *